US010458086B2

(12) United States Patent
Morii et al.

(10) Patent No.: US 10,458,086 B2
(45) Date of Patent: Oct. 29, 2019

(54) FLOATING FLAP GATE

(71) Applicant: HITACHI ZOSEN CORPORATION, Osaka (JP)

(72) Inventors: Toshiaki Morii, Osaka (JP); Toshikazu Tanaka, Osaka (JP); Takahide Inagaki, Osaka (JP); Kyoichi Nakayasu, Osaka (JP)

(73) Assignee: HITACHI ZOSEN CORPORATION, Osaka (JP)

( * ) Notice: Subject to any disclaimer, the term of this patent is extended or adjusted under 35 U.S.C. 154(b) by 0 days.

(21) Appl. No.: 15/528,696

(22) PCT Filed: Aug. 19, 2015

(86) PCT No.: PCT/JP2015/073191
§ 371 (c)(1),
(2) Date: May 22, 2017

(87) PCT Pub. No.: WO2016/084433
PCT Pub. Date: Jun. 2, 2016

(65) Prior Publication Data

US 2017/0292238 A1 Oct. 12, 2017

(30) Foreign Application Priority Data

Nov. 28, 2014 (JP) ..... 2014-241559

(51) Int. Cl.
*E02B 7/40* (2006.01)
*E02B 7/38* (2006.01)
(Continued)

(52) U.S. Cl.
CPC ..... *E02B 7/38* (2013.01); *E02B 3/104* (2013.01); *E02B 7/40* (2013.01); *E02B 7/44* (2013.01);
(Continued)

(58) Field of Classification Search
CPC ..... E06B 2009/007; F16K 31/30
See application file for complete search history.

(56) References Cited

U.S. PATENT DOCUMENTS 3,775,983 A * 12/1973 Aubert ..... E02B 7/44 405/102
3,925,999 A * 12/1975 Andrew ..... B63C 1/08 405/101
(Continued)

FOREIGN PATENT DOCUMENTS

CN 2820957 Y 9/2006
CN 102086640 A 6/2011
(Continued)

OTHER PUBLICATIONS

International Search Report as issued in International Patent Application No. PCT/JP2015/073191, dated Oct. 20, 2015.
(Continued)

*Primary Examiner* — Sean D Andrish
(74) *Attorney, Agent, or Firm* — Pillsbury Winthrop Shaw Pittman, LLP

(57) ABSTRACT

Described herein is a floating flap gate including a gate leaf having a buoyancy forming portion, the gate leaf being configured to be raised due to buoyancy effect (e.g., from water), a bottom fitting mounted to a proximal end portion of the gate leaf, the bottom fitting having a convex circular arc-shaped surface across a width direction of the gate leaf, a plate member having a concave circular arc-shaped surface to be mated with the convex circular arc-shaped surface of the bottom fitting when the gate leaf is in a lowered state, wherein the concave circular arc-shaped surface is in contact with the convex circular arc-shaped surface when the gate leaf is raised.

12 Claims, 4 Drawing Sheets

(51) Int. Cl.

| | |
|---|---|
| ***E02B 7/50*** | (2006.01) |
| ***E04H 9/14*** | (2006.01) |
| ***E02B 7/44*** | (2006.01) |
| ***E02B 7/54*** | (2006.01) |
| ***E02B 3/10*** | (2006.01) |
| ***E06B 9/04*** | (2006.01) |
| *E06B 9/00* | (2006.01) |

(52) U.S. Cl.
CPC ..... *E02B 7/50* (2013.01); *E02B 7/54* (2013.01); *E04H 9/14* (2013.01); *E06B 9/04* (2013.01); *E06B 2009/007* (2013.01)

(56) References Cited

U.S. PATENT DOCUMENTS

| | | | | |
|---|---|---|---|---|
| 4,787,774 | A * | 11/1988 | Grove | E02B 7/005 405/101 |
| 2001/0006591 | A1 * | 7/2001 | Nomura | E02B 3/104 405/107 |
| 2009/0180835 | A1 * | 7/2009 | Obermeyer | E02B 3/102 405/87 |
| 2012/0294678 | A1 | 11/2012 | Nakayasu et al. | |

FOREIGN PATENT DOCUMENTS

| | | | |
|---|---|---|---|
| CN | 102713075 | A | 10/2012 |
| CN | 103243689 | A | 8/2013 |
| DE | 10302744 | * | 7/2004 |
| JP | H10-121444 | A | 5/1998 |
| JP | H10-252043 | | 9/1998 |
| JP | 2000-319858 | A | 11/2000 |
| JP | 2001-200524 | A | 7/2001 |
| JP | 3605739 | B | 12/2004 |
| JP | 2012-062742 | A | 3/2012 |
| JP | 2013-002250 | A | 1/2013 |

OTHER PUBLICATIONS

Extended European Search Report EP Application No. 15862542.6 dated Jun. 15, 2018.
Office Action Chinese Patent Application No. 201580064233.0 dated Jun. 1, 2018 with English translation.

* cited by examiner

FLOATING FLAP GATE

CROSS-REFERENCE TO RELATED APPLICATIONS

This application is the U.S. National Stage of PCT/JP2015/073191, filed Aug. 19, 2015, which in turn claims priority to Japanese Patent Application No. JP 2014-241559, filed Nov. 28, 2014. The contents of these applications are incorporated herein by reference in their entireties.

TECHNICAL FIELD

The present invention relates to a floating flap gate that is installed on a road surface at an entrance portion of a building or an underground space in order to prevent, for example, at the time of rising water, the rising water from flowing into the building or the underground space by raising, at the time of rising water, a gate leaf to block the entrance portion.

BACKGROUND

In some cases, on a road surface at an entrance portion of a building or an underground space, a floating flap gate that is configured to block said entrance portion is installed in order to prevent, at the time of rising water, the rising water from flowing into the building or the underground space.

The floating flap gate of this type has a configuration in which the gate leaf is provided with a buoyancy forming portion, and by using water pressure of water flowing into the entrance portion of the building or the underground space and buoyancy of the gate leaf itself, the gate leaf is raised to block said entrance portion.

The gate leaf of the floating flap gate is installed on the road surface or a receiving base provided on the road surface so as to be freely rotatable via a hinge provided at each of two locations on the gate leaf in a width direction thereof (see, for example, Patent Literature 1).

In a case, however, where the gate leaf is structured to be raised via the hinge, such a complicated structure requires higher levels of manufacturing precision and assembly precision, resulting in an increase in manufacturing man-hour. Furthermore, a load acting on the gate leaf is concentrated on the hinge, thus requiring a frame that is a component of the gate leaf to have high strength.

RELEVANT REFERENCES

List of Relevant Patent Literatures

Patent Literature 1: JP H10-121444 A

SUMMARY

The present invention is to solve a problem that the floating flap gate having a configuration in which the gate leaf is installed on a road surface or the receiving base provided on the road surface so as to be freely rotatable via the hinge is complicated in structure, resulting in an increase in manufacturing man-hour. Furthermore, the present invention is also to solve another problem that a load is concentrated on the hinge, thus requiring the frame that is a component of the gate leaf to have high strength.

The present invention has been made to achieve an object to structurally simplify a frame that is a component of a gate leaf and reduce required levels of manufacturing precision and assembly precision, thereby reducing a manufacturing man-hour, based on a simplification of a support portion structure of the gate leaf by adopting a structure in which a load acting on the gate leaf is not concentrated thereon but dispersed.

The present invention is to provide a floating flap gate that is installed on a road surface at an entrance portion of a building or an underground space in order to block the entrance portion at the time of rising water, and configured so that a distal end side of the gate leaf is able to swing upward in a height direction along a water inflow direction around a proximal end side of the gate leaf as a fulcrum. The floating flap gate is characterized most principally in that an upward swinging support portion that is provided on the proximal end side of the gate leaf is composed of a bottom fitting, a resin plate, a waterproof membrane, a first seal clamp, and a second seal clamp, which are described below.

The bottom fitting is mounted to an end portion of the gate leaf on the proximal end side, has a length equal to a width of the gate leaf, and has a convex circular arc-shaped surface formed at a proximal end side corner portion of a surface of the gate leaf in a lowered state.

The resin plate is to support the gate leaf in a raised state as a receiving seat to receive a portion of the bottom fitting in which portion the convex circular arc-shaped surface is formed, is equal in length to the bottom fitting, and has a concave circular arc-shaped surface to be mated with the convex circular arc-shaped surface of the bottom fitting.

The waterproof membrane is disposed on a surface side of each of the bottom fitting and the resin plate so as to cover the bottom fitting and the resin plate.

The first seal clamp is mounted on the surface side of the bottom fitting so as to integrally sandwich a portion of the waterproof membrane which portion covers the bottom fitting, between itself and the bottom fitting.

The second seal clamp is mounted on the surface side of the resin plate so as to integrally sandwich a portion of the waterproof membrane which portion covers the resin plate, between itself and the resin plate or a base disposed on the proximal end side of the gate leaf.

In the present invention described above, the gate leaf is supported in such a manner that the portion of the bottom fitting mounted to the end portion of the gate leaf on the proximal end side and having a length equal to a width of the gate leaf, in which the convex circular arc-shaped surface is formed, is received by the resin plate as the receiving seat, which has the concave circular arc-shaped surface to be mated with the convex circular arc-shaped surface and is equal in length to the bottom fitting. Accordingly, the gate leaf can be supported, with a load acting by itself being dispersed, and thus a frame that is a component of the gate leaf can be structurally simplified.

Furthermore, the support portion of the gate leaf is composed of the bottom fitting, the resin plate, the waterproof membrane disposed so as to cover the bottom fitting and the resin plate, the first seal clamp that integrally sandwiches the waterproof membrane between itself and the bottom fitting, and the second seal clamp that integrally sandwiches the waterproof membrane between itself and the resin plate or the base. Accordingly, a configuration of the support portion can be simplified, and thus it is possible to reduce required levels of manufacturing precision and assembly precision and hence a manufacturing man-hour.

ADVANTAGES

According to the present invention, the gate leaf can be supported, with a load acting by itself being dispersed, and thus a frame that is a component of the gate leaf can be structurally simplified. Furthermore, a configuration of the support portion can be simplified, and thus it is possible to reduce required levels of manufacturing precision and assembly precision and hence a manufacturing man-hour.

DESCRIPTION OF THE PREFERRED EMBODIMENTS

The present invention has as its object to structurally simplify a frame of a gate leaf by adopting a structure in which a load acting on the gate leaf is dispersed and to reduce required levels of manufacturing precision and assembly precision, thereby reducing a manufacturing man-hour.

Further, the present invention has achieved the object by adopting a structure in which the end portion of the gate leaf on the proximal end side is supported in such a manner that the portion of the bottom fitting having a length equal to a width of the gate leaf, in which the convex circular arc-shaped surface is formed, is received by the resin plate as the receiving seat, which has the concave circular arc-shaped surface to be mated with the convex circular arc-shaped surface and is equal in length to the bottom fitting.

EMBODIMENTS

Figure 1:
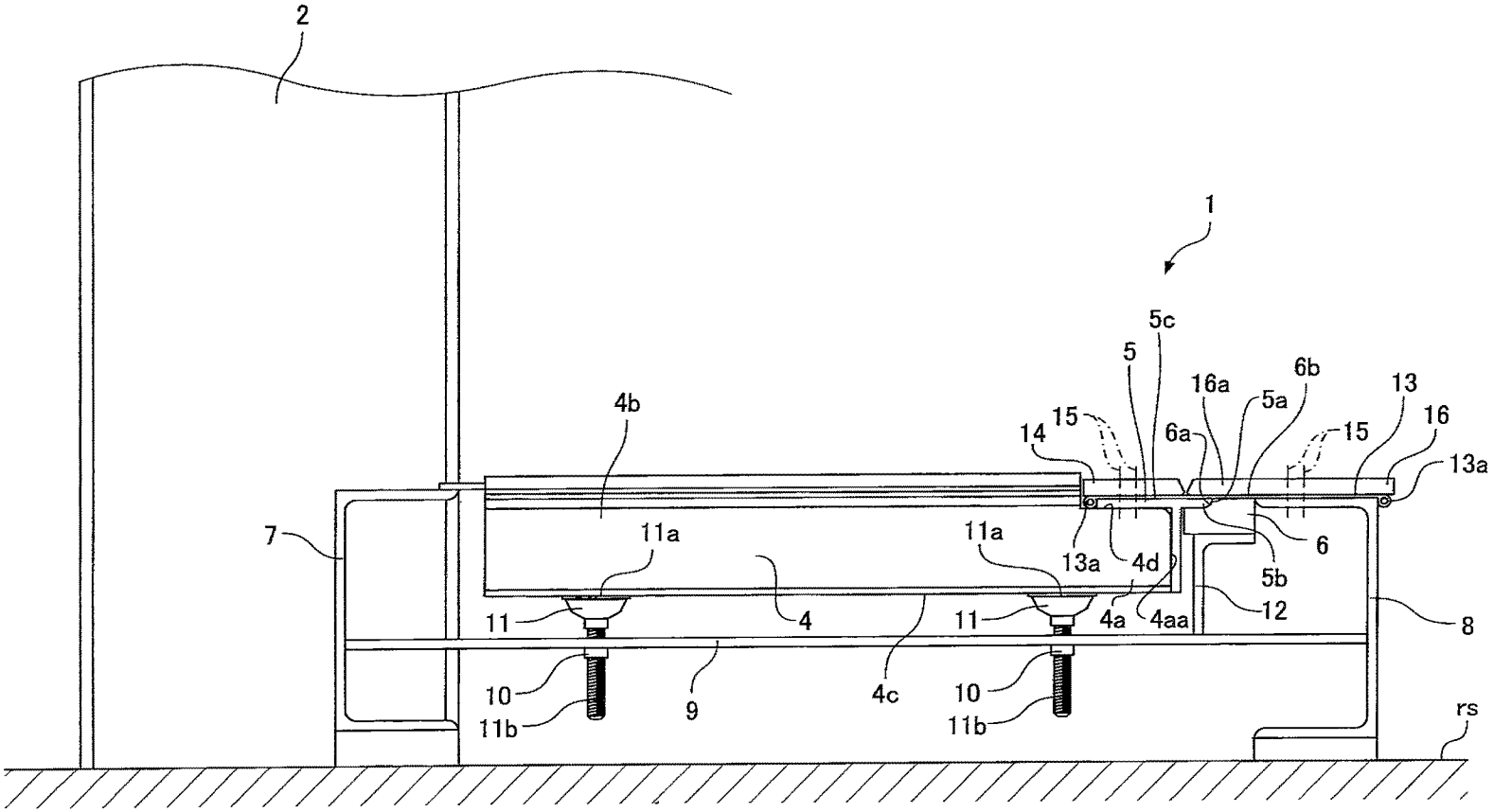
FIG. 1 is a view, as seen from a side, of a floating flap gate of the present invention as a whole.
Figure 2:
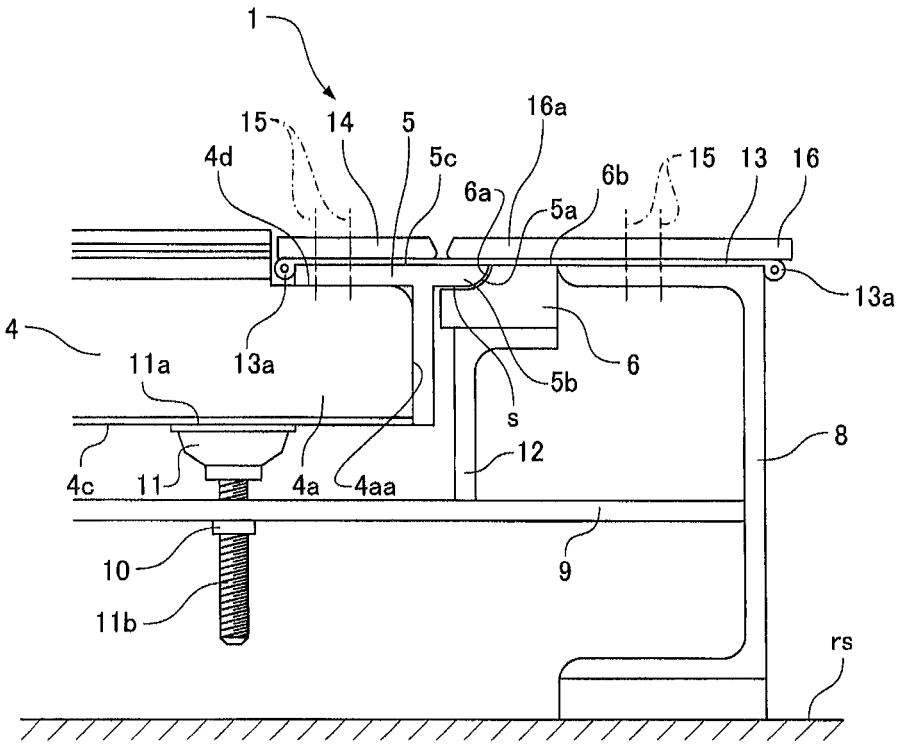
FIG. 2 is an enlarged view of a proximal end side of a gate leaf shown in FIG. 1.
Figure 3:
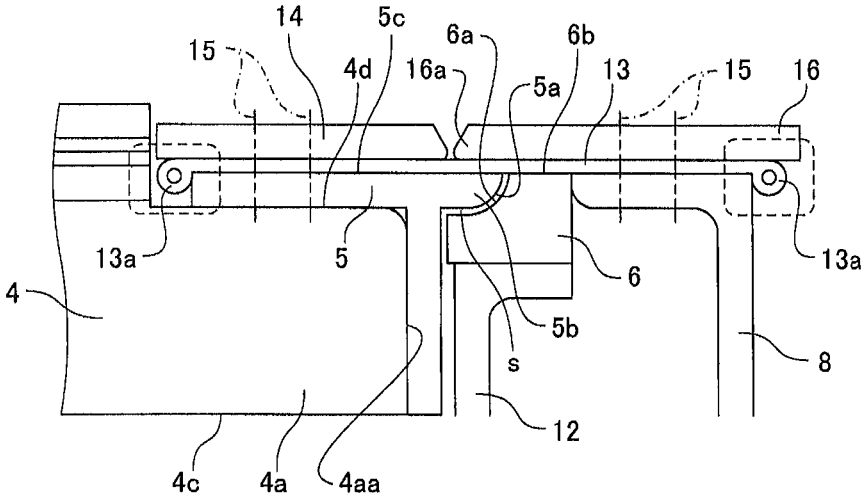
FIG. 3 is an enlarged view of an upward swinging support portion of the gate leaf shown in FIG. 1.

With reference to FIG. 1 to FIG. 5, the following describes one embodiment of the present invention in detail. FIG. 1 is a view, as seen from a side, of a floating flap gate of the present invention as a whole, FIG. 2 is an enlarged view of a proximal end side of a gate leaf shown in FIG. 1, and FIG. 3 is an enlarged view of an upward swinging support portion of the gate leaf shown in FIG. 1.

In FIG. 1 to FIG. 3, reference number 1 denotes a floating flap gate of the present invention. The floating flap gate 1 may be installed, usually in a lowered state, on a road surface "rs" between side walls 2 installed at, for example, an entrance portion of a building or an underground space. The floating flap gate 1 blocks the entrance portion in a water-tight state by raising the end portion 4*b* of the gate leaf 4 having buoyancy generating ability on the distal end side thereof with an end portion 4*a* of the gate leaf 4 on a proximal end side thereof as a fulcrum by using pressure of water flowing into an entrance portion of a building or an underground space. Hereinafter, the end portion of the gate leaf 4 on the proximal end side is referred to as a proximal end portion 4*a*. Furthermore, the end portion thereof on the distal end side is referred to as a distal end portion 4*b*.

In the floating flap gate 1 of the present invention, an upward swinging support portion provided at the proximal end portion 4*a* of the gate leaf 4 may have a configuration described below.

Reference number 5 denotes a bottom fitting of, for example, an L shape that may be mounted in a water-tight state so as to be in contact with an end surface 4*a*a of the gate leaf 4 in the proximal end portion 4*a* and a surface 4*d* of the gate leaf 4 in the lowered state. The bottom fitting 5 may have a length equal to a width of the gate leaf 4 so as to exist over an entire region of the gate leaf 4 in a width direction thereof. Further, a portion of the bottom fitting 5, which is in contact with the surface 4*d* of the gate leaf 4, may be made to protrude in an opposite direction to the distal end portion 4*b* of the gate leaf 4, forming a convex circular arc-shaped surface 5*a* on a side opposed to the road surface "rs". Hereinafter, the portion made to protrude to form the convex circular arc-shaped surface 5*a* is referred to as a protruding portion 5*b*.

Reference number 6 denotes a resin plate that may have a length equal to the length of the bottom fitting 5 and have a surface opposed to the convex circular arc-shaped surface 5*a* of the bottom fitting 5, which is formed in such a concave circular arc shape as to be mated with the convex circular arc-shaped surface 5*a*. Hereinafter, this surface formed in the concave circular arc shape is referred to as a concave circular arc-shaped surface 6*a*.

In an embodiment shown in FIG. 1 to FIG. 3, the gate leaf 4 in the lowered state may be supported on a back surface 4*c* thereof on its distal end side and its proximal end side by a plurality of gate leaf receiving members 11 disposed at a predetermined interval therebetween in the height direction (a direction parallel to a plane of each of FIG. 1 to FIG. 3) of the gate leaf 4. Each of the gate leaf receiving members 11 may have a receiving surface 11*a* to receive the gate leaf 4*b* and a screw shaft 11*b* provided on an opposite side to the receiving surface 11*a*. Each of the gate leaf receiving members 11 may be configured to be able to adjust a position of the receiving surface 11*a* in a height direction, which supports the gate leaf 4 in the lowered state, by screw-fitting the screw shaft 11*b* into a female screw member 10 securely disposed on a lower surface of a horizontal member 9 connecting a middle portion of a base 8 in a height direction, which is provided on the proximal end side of the gate leaf 4, to a middle portion of a gate leaf distal end receiving member 7 in a height direction, which is provided on the distal end side of the gate leaf 4.

The gate leaf distal end receiving member 7 that is in contact with the distal end side of the gate leaf 4 in the lowered state and the base 8 provided on the proximal end side of the gate leaf 4 may have a length equal to the width of the gate leaf 4.

The resin plate 6 may be placed on a resin plate receiving member 12 disposed on the horizontal member 9. When the gate leaf 4 is in the lowered state and thus is supported by the door receiving members 11, a gap "s" may be formed between the concave circular arc-shaped surface 6*a* of the resin plate 6 and the convex circular arc-shaped surface 5*a* of the bottom fitting 6 (see FIG. 3).

Reference number 13 denotes a waterproof membrane that is disposed to extend over a surface 5*c* of the bottom fitting 5 and a surface 6*b* of the resin plate 6. The waterproof membrane 13 cover the bottom fitting 5 and the resin plate 6, thus preventing water leakage from, for example, the gap "s" between the bottom fitting 5 and the resin plate 6, a space between the resin plate 6 and the base 8, or the like.

On a portion of the waterproof membrane 13, which covers the bottom fitting 5, a first seal clamp 14 is disposed. The first seal clamp 14, the waterproof membrane 13, and the bottom fitting 5 are integrally fastened together by, for example, a bolt 15.

Furthermore, on another portion of the waterproof membrane 13, which covers the resin plate 6, a second seal clamp 16 is disposed. The second seal clamp 16, the waterproof membrane 13, and, for example, the base 8 may be integrally fastened together by another bolt 15.

In order to be able to support the bottom fitting 5 via the waterproof membrane 13 when the gate leaf 4 has been raised and floated up under buoyancy and water pressure, the second seal clamp 16 may have such a length that an end portion 16*a* thereof on a first seal clamp 14 side extends to above the protruding portion 5*b* of the bottom fitting 5.

Figure 4:
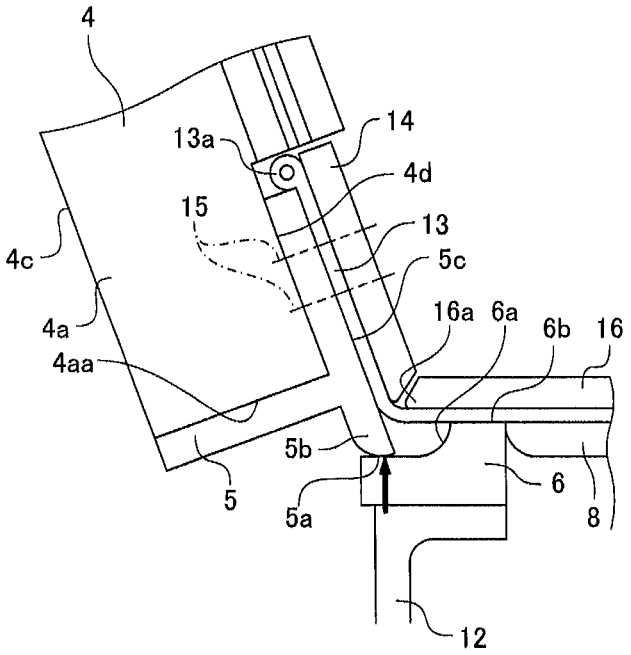
FIG. 4 is a view, as seen from a side of the upward swinging support portion, showing a state where, in the floating flap gate of the present invention when raised, a weight of the gate leaf is supported by a resin plate.

In the floating flap gate 1 of the present invention configured as above, in a case where water flows in to cause the gate leaf 4 to be raised, as shown in FIG. 4, the concave circular arc-shaped surface 6*a* of the resin plate 6 may function as a receiving seat to receive the protruding portion 5*b* of the bottom fitting 5 and support a weight of the gate leaf 4 at a position indicated by an arrow. To clarify, as shown in FIG. 4, the arrow is at a flat surface. The flat surface is illustrated as adjacent to and continuously formed with the concave circular arc-shaped surface 6*a*. Thus, as shown in FIG. 4, when the gate leaf 4 is raised the convex circular arc-shaped surface 5*b* of the bottom fitting 5 is apart from the concave circular arc-shaped surface 6*a* and in contact with the flat surface. That is, in the present invention, the bottom fitting 5 and the waterproof membrane 13 may fulfill a hinge function.

Figure 5:
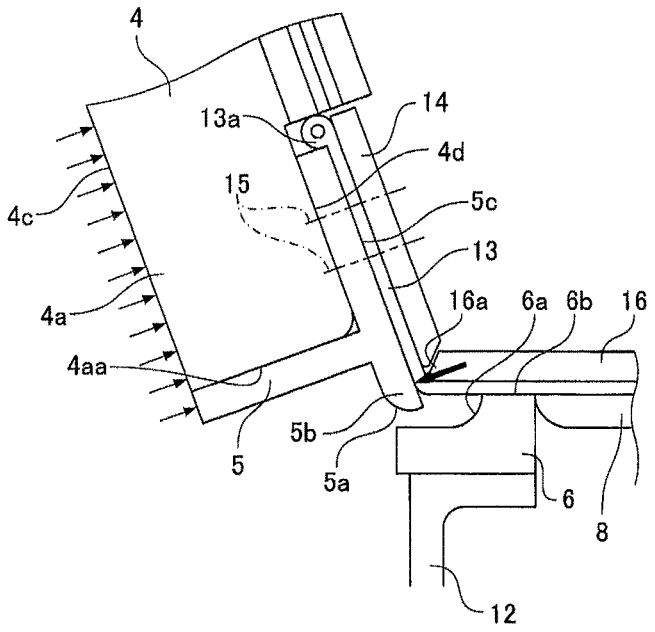
FIG. 5 is a view, as seen from the side of the upward swinging support portion, showing a state of supporting a hydraulic load in a case where, in the floating flap gate of the present invention when raised, the gate leaf has floated up under said hydraulic load.

On the other hand, in a case where the gate leaf 4 in a raised state floats up under buoyancy and water pressure, as shown in FIG. 5, the gate leaf 4 under buoyancy and water pressure may be supported at the end portion 16*a* (a position indicated by an arrow) of the second seal clamp 16 on the first seal clamp side.

When the gate leaf 4 under buoyancy and water pressure is supported in such a state, the waterproof membrane 13 may be subjected to a tensile load. Accordingly, in order to suppress stretching of the waterproof membrane 13 when subjected to a tensile load, it may be desirable that a fiber-containing film is used as the waterproof membrane 13.

Furthermore, together with a tensile load, a pull-out load may be exerted on the waterproof membrane 13, and thus it may be desirable that the waterproof membrane 13 is shaped to be thicker at end portions 13*a* thereof on each of the distal end side and the proximal end side of the gate leaf 4 than at a center portion thereof so that the waterproof membrane 13 is prevented from being pulled out even when a pull-out load is exerted thereon.

Needless to say, the present invention is not limited to the above-described example, and changes can be made to the embodiment as appropriate without departing from the technical scope recited in the claims.

Figure 6:
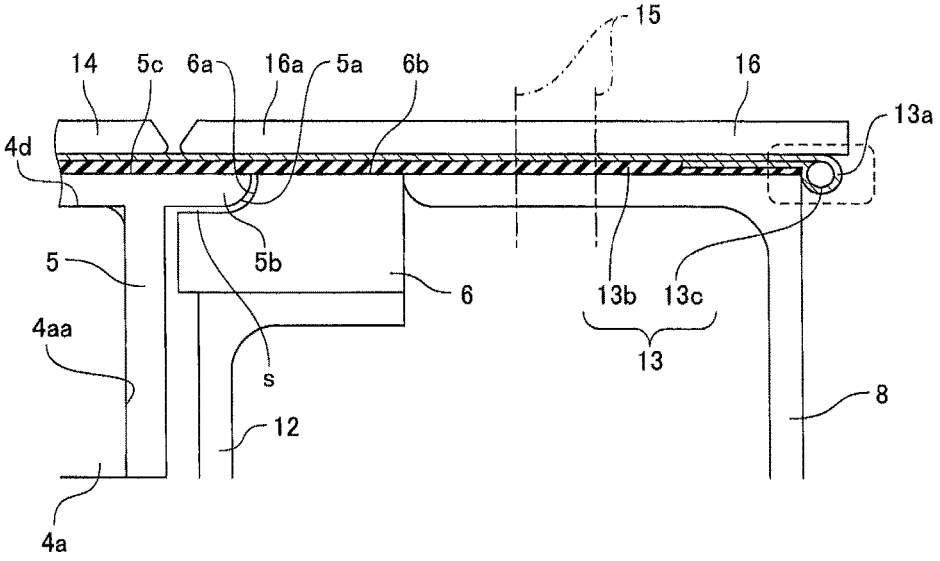
FIG. 6 is a view explaining another configuration of a waterproof membrane.

For example, as shown in FIG. 6, it may also be possible that the water cut-off film 13 has a double structure composed of a fiber film 13*b* having tensile strength and a rubber film 13*c* having a water cut-off capability.

Furthermore, while the above-described example has explained a case where the floating flap gate 1 of the present invention is installed at an entrance portion of a building or an underground space, the floating flap gate 1 of the present invention can be installed also at, without being limited to an entrance portion of a building or an underground space, for example, an opening portion of a seawall or a breakwater.

LIST OF REFERENCE NUMBERS

1 floating flap gate
4 gate leaf
4*a* proximal end portion
4*b* distal end portion
4*d* surface
5 bottom fitting
5*a* convex circular arc-shaped surface
5*b* protruding portion
5*c* surface
6 resin plate
6*a* concave circular arc-shaped surface
6*b* surface
8 base
13 waterproof membrane
14 first seal clamp
16 second seal clamp
16*a* end portion
rs road surface
s gap

The invention claimed is:

1. A floating flap gate comprising:

a gate leaf configured to be raised by buoyancy effect;

a bottom fitting mounted to a proximal end portion of the gate leaf and having a convex circular arc-shaped surface across a width direction of the gate leaf; and a plate member having a concave circular arc-shaped surface and a flat surface adjacent to and continuously formed with the concave circular arc-shaped surface;

wherein the concave circular arc-shaped surface is mated with the convex circular arc-shaped surface of the bottom fitting when the gate leaf is in a lowered state, wherein when the gate leaf is raised the convex circular arc-shaped surface of the bottom fitting is apart from the concave circular arc-shaped surface and in contact with the flat surface.

2. The floating flap gate according to claim 1, further comprising:

a waterproof membrane disposed on a surface side of each of the bottom fitting and the plate member when the gate leaf is in the lowered state;

a first seal clamp sandwiching the waterproof membrane between the first seal clamp and the bottom fitting; and a second seal clamp sandwiching the waterproof membrane between the second seal clamp and the plate member.

3. The floating flap gate according to claim 2, wherein the gate leaf is supported at the proximal end portion thereof in the raised state by an end portion of the second seal clamp.

4. The floating flap gate according to claim 2, wherein when the gate leaf is lowered, a gap is present between the convex circular arc-shaped surface and the concave circular arc-shaped surface; the gate further comprising:

the first seal clamp mounted on a surface side of the bottom fitting so as to integrally sandwich a portion of the waterproof membrane which portion covers the bottom fitting, between the first seal clamp and the bottom fitting; and the second seal clamp mounted on a surface side of the plate member so as to integrally sandwich another portion of the waterproof membrane which portion covers the plate member, between the second seal clamp and the resin plate or a base disposed on the proximal end side of the gate leaf.

5. The floating flap gate according to claim 2, wherein the waterproof membrane bends at a hinge portion when the gate leaf is raised, and the hinge portion is a part of the waterproof membrane surrounded by the first seal clamp, the second seal clamp and the bottom fitting in a lowered state of the gate leaf.

6. The floating flap gate according to claim 5, wherein the gate leaf is supported at the proximal end by an end portion of the second seal clamp when the gate leaf is raised.

7. The floating flap gate according to claim 1, wherein the plate member is a resin plate.

8. The floating flap gate of claim 1, wherein the gate leaf is configured to be raised by buoyancy effect without applying a power source for raising up the gate leaf.

9. A floating flap gate comprising:

a gate leaf configured to be raised by buoyancy effect;

a bottom fitting mounted to a proximal end portion of the gate leaf—and having a convex circular arc-shaped surface across a width direction of the gate leaf;

a plate member having a concave circular arc-shaped surface and a flat surface adjacent to and continuously formed with the concave circular arc-shaped surface;

a seal clamp attached to the plate member;

wherein the concave circular arc-shaped surface is mated with the convex circular arc-shaped surface of the bottom fitting when the gate leaf is in a lowered state, wherein when the gate leaf is raised the convex circular arc-shaped surface of the bottom fitting is detached from the plate member, and the gate leaf is supported by an end portion of the seal clamp.

10. A floating flap gate comprising:

a gate leaf configured to be raised by buoyancy and water pressure acting thereon without applying a power source for rising up the gate leaf at a time of rising water;

a bottom fitting attached to a proximal end portion of the gate leaf and having a convex circular arc-shaped surface across a width direction thereof;

a plate member having a concave circular arc-shaped surface and a flat surface adjacent to and continuously formed with the concave circular arc-shaped surface; and a door receiving member supporting the gate leaf when the gate leaf is in a lowered state;

wherein the concave circular arc-shaped surface is mated with the convex circular arc-shaped surface of the bottom fitting when the gate leaf is in a lowered state, and wherein when the gate leaf is raised the convex circular arc-shaped surface of the bottom fitting is apart from the concave circular arc-shaped surface and in contact with the flat surface.

11. The floating flap gate of claim 10, further comprising:

a bendable waterproof membrane disposed on an upper surface side of each of the proximal end portion of the gate leaf and the plate member when the gate leaf is in a lowered state;

a first seal clamp mounted on the bottom fitting so as to integrally sandwich a portion of the waterproof membrane which portion covers the bottom fitting, between the first seal clamp and the bottom fitting; and a second seal clamp mounted on the plate member so as to integrally sandwich another portion of the waterproof membrane which portion covers the plate member, between the second seal clamp and the plate member.

12. The floating flap gate of claim 11, wherein the bottom fitting comprises a protruding portion, and wherein the second seal clamp has such a length that an end portion thereof extends to above the protruding portion of the bottom fitting.

* * * * *